United States Patent [19]

Giachino et al.

[11] Patent Number: 4,742,265

[45] Date of Patent: May 3, 1988

[54] SPARK PLUG CENTER ELECTRODE OF ALLOY MATERIAL INCLUDING ALUMINUM AND CHROMIUM

[75] Inventors: Joseph M. Giachino, Farmington Hills; David W. Hoffman, Ann Arbor; William F. Horn, Plymouth; Gerald P. Kazmer, Roseville, all of Mich.

[73] Assignee: Ford Motor Company, Dearborn, Mich.

[21] Appl. No.: 929,702

[22] Filed: Nov. 12, 1986

[51] Int. Cl.[4] ..... H01T 13/20

[52] U.S. Cl. ..... 313/141; 313/118

[58] Field of Search ..... 313/118, 141

[56] References Cited

U.S. PATENT DOCUMENTS 3,956,657 5/1976 Siegle ..... 313/124 X 4,324,588 4/1982 Zysk et al. ..... 313/141 X

OTHER PUBLICATIONS

Boone, D. H.; Strangman, T. E.; Wilson, L. W.; "Some Effects of Structure and Composition on the Properties of Electron Beam Vapor Deposited Coatings for Gas Turbine Superalloys", J. Vac. Sci. Technol., 11(4) 641, 8/1974.

Strangman, T. E.; Hopkins, S. W.; "Thermal Fatigue of Coated Superalloys", Bul. Am. Ceram. Soc. 55, (3)305, 3/1976.

*Primary Examiner*—David K. Moore

*Assistant Examiner*—K. Wieder

*Attorney, Agent, or Firm*—Peter Abolins; Keith L. Zerschling

[57] ABSTRACT

A spark plug for providing an ignition spark has a center electrode. At least a portion of the center electrode contains an alloy material from an alloy family of M-CrAlY wherein M is nickel, cobalt, iron or a combination of these elements and Cr is chromium, Al is aluminum, Y is an element from the group yttrium, zirconium, hafnium or titanium.

11 Claims, 2 Drawing Sheets

SPARK PLUG CENTER ELECTRODE OF ALLOY MATERIAL INCLUDING ALUMINUM AND CHROMIUM

BACKGROUND OF THE INVENTION

1. Field of the Invention

This invention relates to spark plugs and, in particular, to materials for a spark plug.

2. Prior Art

Prolonging the life of spark plugs is desirable for a variety of reasons including meeting government regulations, reducing cost, minimizing maintenance and improving reliability. Typically, current production spark plugs have an expected life of about 30,000 miles, One of the major limiting factors of spark plug life is the deterioration of the center electrode. Attempts to overcome this limitation have included developing platinum-tipped center electrodes. For example, a thin platinum pin can be inserted in the ceramic insulator before sintering. Alternatively, a small platinum disk can be recessed into the turned down tip of a conventional electrode and held in place by spot welding. However, using noble metals, such as platinum, is costly.

The most common materials used for production of center electrodes are nickel alloys such as Inconel (nickel-iron-chromium). These alloys have proven to be adequate to meet durability requirements of about 30,000 miles. A modest degree of durability improvement can be achieved with copper cored center electrodes using a nickel alloy as the cladding material.

There are believed to be two basic mechanisms that contribute to the operational deterioration of the center electrode: (1) spark erosion and (2) chemical corrosion. The relationship of each particular type of deterioration, i.e. spark erosion or chemical attack, in relation to temperature is shown in FIG. 2. Although spark erosion appears to be operative at all temperatures, chemical corrosion appears to be a major contributor at normal operating temperatures.

A study of nickel alloy central electrodes indicates that both chromium oxide and chromium sulfide are formed on the surface of the electrode during normal engine operation. These materials are only weakly bonded to the surface and easily removed. This produces fresh surfaces on the nickel alloy electrode that are again susceptible to further chemical corrosion.

Also known are various coatings used to protect gas turbine super alloy components against oxidation and sulfadation. In particular, a family of alloys called M-CrAlY has been developed,

| | | |
|---|---|---|
| where M = | Ni (Nickel), or<br>Co (Cobalt), or<br>Fe (Iron)<br>or combinations of Nickel, Cobalt and Iron, such as NiCo, FeCo, etc. | |
| Cr = | 15–30 Wt. % | Chromium |
| Al = | 5–15 Wt. % | Aluminum |
| Y = | 0–2 Wt. % | Yttrium or other active elements e.g.<br>Zr (Zirconium)<br>Hf (Hafnium)<br>Ti (Titanium) |

A discussion of the relationship of these alloys to protecting gas turbine super alloy components is in:

(1) Boone, D. H.; Strangman, T. E.; Wilson, L. W.; "Some Effects of Structure and Composition on the Properties of Electron Beam Vapor Deposited Coatings for Gas Turbine Superalloys", J. Vac. Sci. Technol., 11 (4) 641, 1974 and (2) Strangman, T. E.; Hopkins, S. W.; "Thermal Fatigue of Coated Superalloys", Bul. Am. Ceram. Soc. 55, (3) 305, 1976. In this literature, it is taught that the aluminum in the alloys forms a protective scale of $Al_2O_3$ and that the Yttrium provides a strong bond between the $Al_2O_3$ and the metal electrode substrate.

Although the above techniques and structures are known, there still remains a need for a spark plug with a prolonged life. In particular, it would be desirable to have a spark plug with a durable central electrode. These are some of the problems this invention overcomes.

SUMMARY OF THE INVENTION

In accordance with an embodiment of this invention, the M-CrAlY family of alloys is used for the fabrication of an electrode of a spark plug. In particular, when such an alloy is used for the center electrode, or portion of the center electrode, the center electrode is more resistant to chemical corrosion and provides an increased service life. The M-CrAlY alloys can be used in various configurations to fabricate spark plug center electrodes.

DETAILED DESCRIPTION OF THE INVENTION

Figure 1:
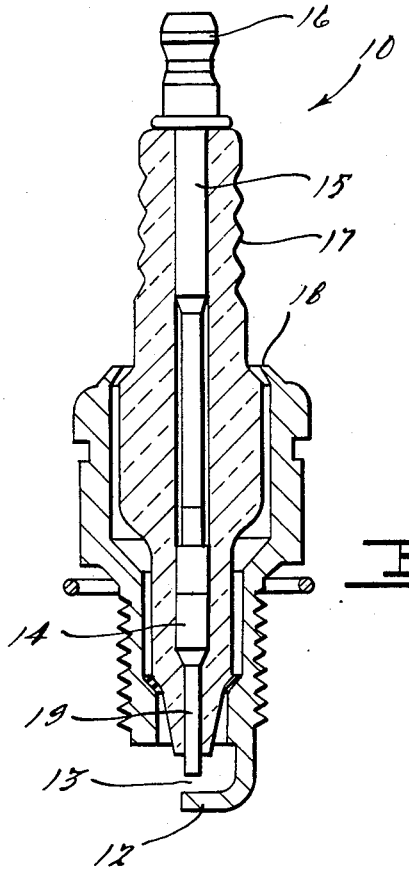
FIG. 1 is a cross section view of a spark plug in accordance with an embodiment of this invention.
Figure 2:
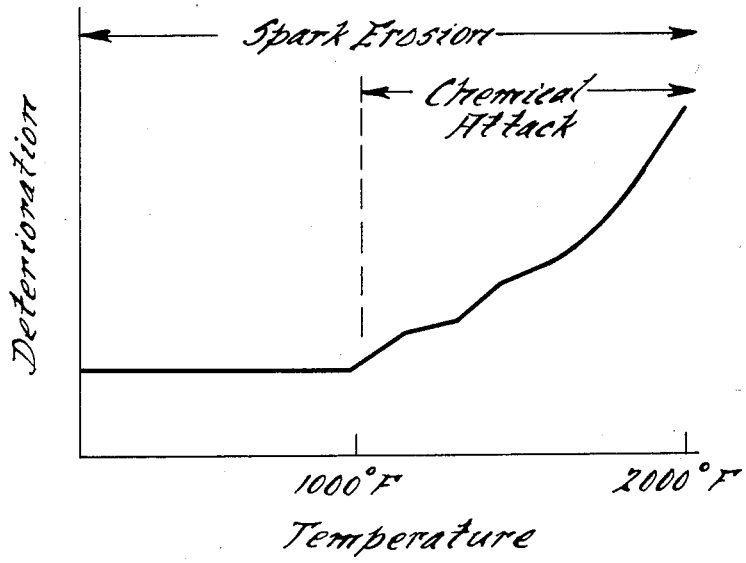
FIG. 2 is a graphical representation relating deterioration for spark erosion and chemical attacks to the temperature operation of a spark plug.

Referring to FIG. 1, a center electrode 19 is positioned coaxially with the main axis of a spark plug 10 and is spaced from an earth or ground electrode 12. A spark gap 13 is positioned between earth electrode 12 and center electrode 19. Center electrode 19 is electrically connected to a conductive seal 14, terminal stud 15 and terminal 16 to couple center electrode 19 to an external circuit. A tubular insulator 17 surrounds terminal stud 15, conductive seal 14 and center electrode 19. Surrounding the central portion of insulator 17 is a body rollover 18.

In accordance with an embodiment of this invention, an alloy from the family of alloys called M-CrAlY is used for the fabrication in the center electrode. M is chosen from the group of nickel, cobalt and iron or combinations of these materials. Advantageously, the chromium is 15–30% of the weight of the alloy. The aluminum is 5–15% of the weight of the alloy and the yttrium or other active elements such as zirconium, hafnium or titanium is about 0–1% of the weight of the alloy.

Figure 3:
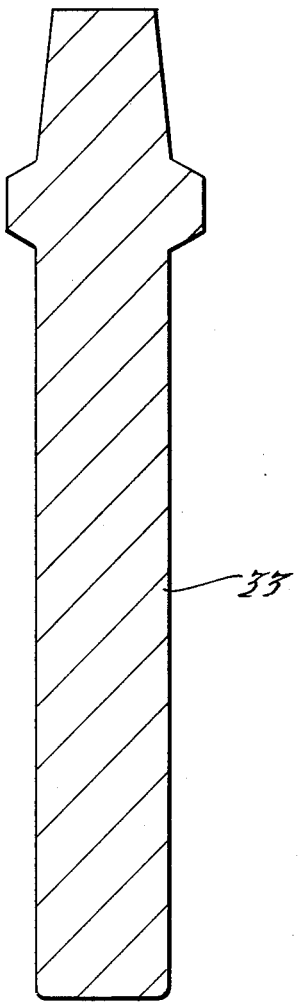
FIG. 3 is a cross section of a center electrode in accordance with an embodiment of this invention including a center electrode formed entirely of M-CrAlY.

The center electrode can be fabricated in a number of ways in accordance with an embodiment of this invention. Referring to FIG. 3, an electrode 33 can totally be fabricated from an alloy of the family of alloys called M-CrAlY.

Figure 4:
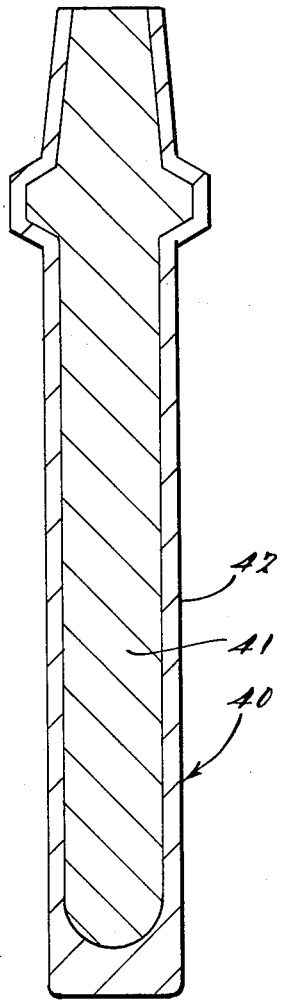
FIG. 4 is a cross section of a center electrode in accordance with one embodiment of this invention including M-CrAlY cladding on a copper core.

Referring to FIG. 4, another way of forming a center electrode 40 in accordance with an embodiment of this invention is to fabricate a copper core electrode 41 and use a M-CrAlY type alloy for a cladding material 42 on copper core electrode 41.

Figure 5:
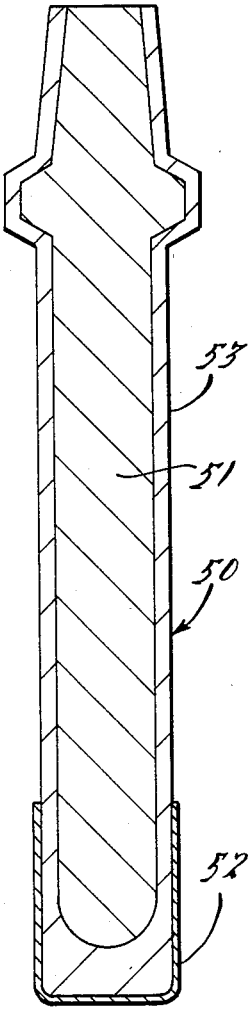
FIG. 5 is a cross section of another embodiment of this invention wherein a M-CrAlY coating is put on a nickel alloy cladding which is on a copper core.

Referring to FIG. 5, a center electrode 50 has a standard or conventional copper core electrode 51 as a substrate with an Inconel cladding 53 and an overlay coating 52 of M-CrAlY covering the tip portion of the Inconel clad substrate electrode 51. There are a number of techniques by which coating 52 may be applied including, for example, electron beam vapor deposition, ion plating, sputtering, plasma spraying or arc source evaporation.

Of the embodiments shown, it is believed that the one shown in FIG. 5 where there is a coating of M-CrAlY on an Inconel clad copper core has the best low cost potential and lends itself to larger volume, batching operations.

Conventional copper core center electrodes with overlay coatings of M-CrAlY of 0.005 inches thickness have been fabricated and tested. For example, a sample of electrodes have been exposed to 1000° C. in air for a total of nine hours without any observable deterioration of the coating. Additional samples of the coated electrodes have been assembled into spark plugs and tested on an engine dynamometer. After a period of fifty hours at 4500 rpm using leaded fuel, scanning electron micrographs show that coatings are still intact. After a 140 hour test with unleaded fuel, equivalent in sparks to 17,000 miles, scanning electron microscopy revealed much less rounding of the coated center electrodes compared to an uncoated Inconel.

Various modifications and variations will no doubt occur to those skilled in the various arts to which this invention pertains. For example, the particular configurations of the center electrode may be varied from that disclosed herein. These and all other variations which basically rely on the teachings through which this disclosure has advanced the art are properly considered within the scope of this invention.

We claim:

1. A spark plug for use in providing an ignition spark including:

a center electrode for providing a conductive path and a grounding electrode, spaced from said center electrode, for providing a conductive path so that a spark can be sustained between said center and grounding electrodes, at least a portion of said center electrode comprising an alloy material from an alloy family of M-CrAlY wherein M is selected from the group consisting of nickel, cobalt, iron and mixtures thereof and Cr is chromium; Al is aluminum; Y is an element selected from the group consisting of yttrium, zirconium, hafnium and titanium.

2. A spark plug as recited in claim 1 wherein said center electrode is formed throughout its volume of said alloy material.

3. A spark plug as recited in claim 1 wherein said center electrode has a copper core and has a cladding of said alloy material.

4. A spark plug as recited in claim 1 wherein said center electrode has a copper core, a nickel alloy cladding and a coating of said alloy material on a portion of said center electrode adjacent said grounding electrode.

5. A spark plug as recited in claim 1 wherein said center electrode is a generally cylindrical, elongated, electrical terminal.

6. A spark plug as recited in claim 4 wherein said alloy material coating is applied by electron beam vapor deposition.

7. A spark plug as recited in claim 4 wherein said alloy material coating is applied by ion plating.

8. A spark plug as recited in claim 4 wherein said alloy material coating is applied by sputtering.

9. A spark plug as recited in claim 4 wherein said alloy material coating is applied by plasma spraying.

10. A spark plug as recited in claim 4 wherein said alloy material coating is applied by arc source evaporation.

11. A spark plug as recited in claim 1 wherein said chromium is between 15–30% by weight of said alloy material, said aluminum is between 5–15% by weight of said alloy material and the element chosen from the group yttrium, zirconium, hafnium or titanium, is between 0–1% by weight of said alloy material.

* * * * *